United States Patent [19]

Aoyama

[11] Patent Number: 5,033,532

[45] Date of Patent: Jul. 23, 1991

[54] DIE CASTING METHOD

[75] Inventor: Shunzo Aoyama, Wakoh, Japan

[73] Assignee: Ahresty Corporation, Tokyo, Japan

[21] Appl. No.: 497,888

[22] Filed: May 24, 1989

Related U.S. Application Data

[63] Continuation-in-part of Ser. No. 356,121, May 24, 1989, abandoned.

[30] Foreign Application Priority Data

May 25, 1988 [JP] Japan ..... 63-129366

[51] Int. Cl.[5] ..... B22C 3/00; B22D 17/08; B22D 17/22

[52] U.S. Cl. ..... 164/72; 164/120; 164/138

[58] Field of Search ..... 164/72, 120, 138

[56] References Cited

U.S. PATENT DOCUMENTS

| | | | |
|---|---|---|---|
| 3,387,646 | 6/1968 | Lauth | 164/120 |
| 3,472,308 | 10/1969 | Lauth | 164/120 X |
| 4,264,052 | 4/1981 | Radtke et al. | 164/72 X |
| 4,425,411 | 1/1984 | Textor et al. | 164/72 X |

FOREIGN PATENT DOCUMENTS

| | | | |
|---|---|---|---|
| 51-17121 | 2/1976 | Japan | 164/138 |
| 56-111560 | 9/1981 | Japan | 164/138 |
| 61-296946 | 12/1986 | Japan | 164/138 |
| 1127945 | 9/1968 | United Kingdom | 164/72 |

*Primary Examiner*—Richard K. Seidel
*Assistant Examiner*—J. Reed Batten, Jr.
*Attorney, Agent, or Firm*—Watson, Cole, Grindle & Watson

[57] ABSTRACT

This invention provides a die casting method comprising the steps of that a pulverized insulation agent is coated to form a porous insulation layer on the interior surface of die cavity when a casting products are made by utilizing a die casting machine, wherein a molten metal is filled into the cavity with a slow pace thereon, a high pressure is applied upon the molten metal mechanically so as to crush and make thin the porous insulation layer pressed by the high pressurization upon the molten metal, simultaneously the molten metal sinks into and passes through the porous insulation layer to reach at the interior surface of the cavity wherein the molten metal is rapidly solidified to produce a final casting products according to the temperature drop due to the direct contact with the interior surface of the cavity. By providing the porous insulation layer in the interior surface, the molten metal is well spread on the nook and corner of die cavities during the restriction of solidification speed, thereby can prevent the occurrences of pine hole or blowhole upon the casting product. Further by selecting a lubrication type insulation agent, it can facilitate the removal of casting product from the cavity wherein has no further use for any conventional type mold-releasing agent deemed as a pollutive material.

4 Claims, 4 Drawing Sheets

100 μm

100μm

100μm

DIE CASTING METHOD

CROSS-REFERENCE TO RELATED APPLICATION

This application is a continuation-in-part of application Ser. No. 356,121, filed May 24, 1989, now abandoned.

FIELD OF THE INVENTION AND RELATED ART STATEMENT

Conventionally, it is known that there are many casting methods in the art such as a gravity type casting method, a die casting method, a high pressure die casting method and the like, however, it is also known that they have both merits and demerits in each other. For example, in the gravity casting method or the low pressure casting method, it is known that they are disadvantageous in the castability as their cast products have a certain limitation in the casting form and core thickness as well as their lower productivities since a molten metal is filled in a cavity at a low pressure with a low speed due to restrict the solidification of molten metal during the pouring of molten metal by coating an insulate coating agent on the interior of cavity although it can obtain fine cast products having good mechanical properties with a considerable endurability in their own ways.

In the die casting method, it is known that this method can obtain preferable cast products having a high dimensional accuracy with higher productivity since the molten metal is filled in the cavity at a high pressure with a high speed. However, it is disadvantageous that this casting method often causes unfavourable gas generation from the molten metal during the molten metal is poured and the gases contained in the injection sleeve or its cavity, consequently it is easily productive a defects such as a pine hole or blowhole affected by the gases in the cast core, thus it is difficult sometime to obtain constant good cast products having an uniformed and reliable quantity.

OBJECT AND SUMMARY OF THE INVENTION

It is an object of the invention to provide a novel die casting method capable of casting high quality products without any defects such as a blowhole and the like under a high productivity.

According to the die casting method of the present invention, it is characterized in that providing an amount of pulverized thermal insulation agent which is a dried type power, and coating the pulverized insulation agent on around the interior of a cavity surface arranged in a die casting machine as it is in the powder state, and then a molten metal is filled within the cavity wherein a porous insulation layer is produced by the insulation agent coated therein between the cavity surface and the molten metal because of the high temperature of molten metal itself while a high pressure is applied onto the molten metal upon the completion of filling the molten metal into the cavity.

BRIEF DESCRIPTION OF THE DRAWINGS

FIG. 2 shows the microstructure surface of the present invention with the post pressurization after pouring the molten metal into the cavity, FIG. 3 shows the present invention without the post pressurization intentionally and FIG. 4 shows the microscopic surface having a fine microcomposition made by the conventional die casting method. In comparison with FIG. 3, it can observe that the structure of the present invention in FIG. 2 is almost similar to the conventional of FIG. 4.

DETAILED DESCRIPTION OF PREFERRED EMBODIMENT

Figure 1:
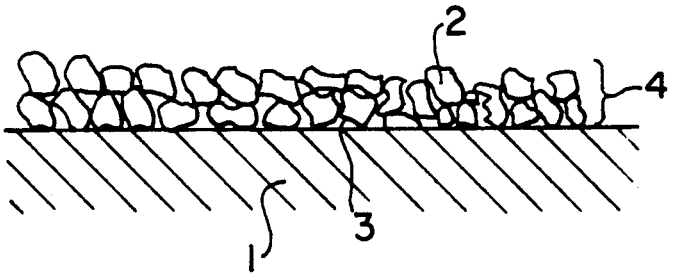
FIG. 1 is a schematic illustration for showing a state coated of a pulverized insulation agent on a cavity surface wherein a porous insulation layer is formed on the surface.
Figure 2:
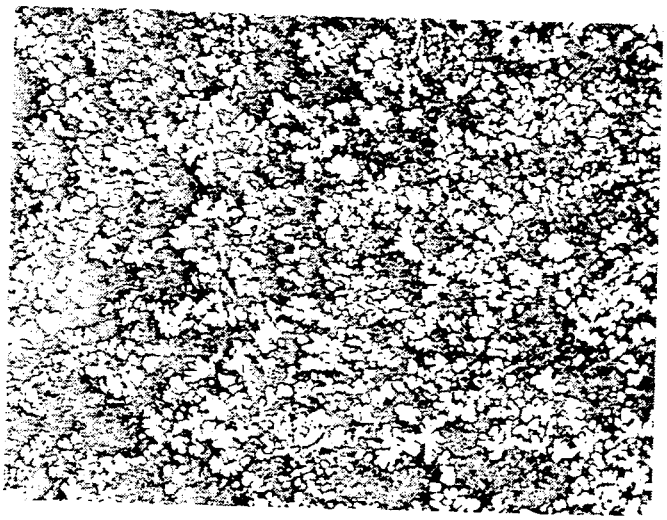
FIG. 2 is a photograph for showing the solidified composition of molten metal according to the casting method of the present invention.
Figure 3:
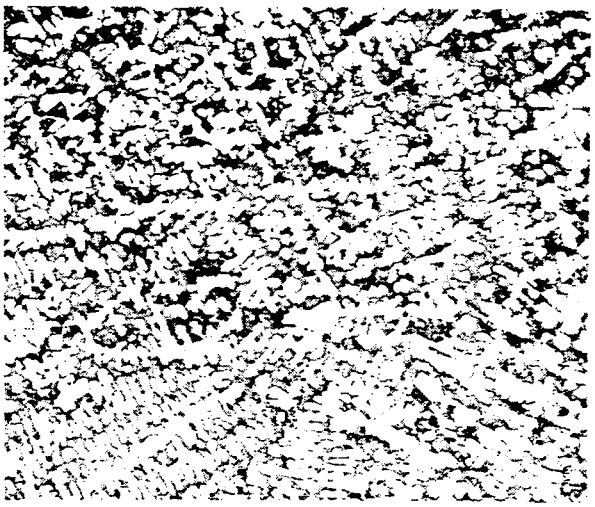
FIG. 3 is another photograph for showing the solidified composition of molten metal when a high pressure is not applied according to the present invention.
Figure 4:
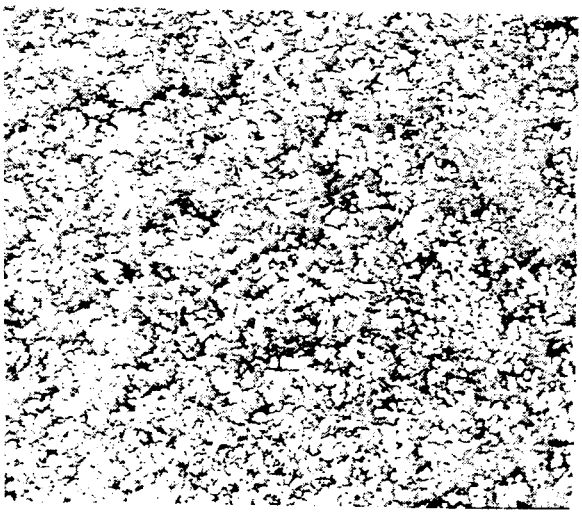
FIG. 4 (PRIOR ART)
FIG. 4 is a further photograph for showing the solidified composition of molten metal according to the conventional.

According to the present invention, the invented die casting method comprises the steps of coating a dried pulverized insulation agent onto a cavity surfaces of both fixed and movable dies (referred to as the die) arranged with a die casting machine; the steps of forming a porous insulation layer onto the cavity surface (coating step); the steps of injecting a molten metal into the cavities at low speed (injection step); and the steps of applying a high pressure on the molten metal filled in the cavities. By coating the dried pulverized insulation agent into the cavity surfaces as it is, a porous insulation layer consisting of an air foams and the pulverized insulation agent is formed onto the cavity surfaces, and then the molten metal becomes to be filled into the cavities, however, due to the existence of the porous insulation layer covered on the cavity surfaces, the injected molten metal does not contact with the cavity surfaces directly in the initial stage and the solidifying speed of the molten metal contained within the cavities is restricted by the existence of the porous insulation layer.

When a high pressure is applied to the molten metal (pressurizing step), the porous insulation layer is pressed by the pressurization and slightly crushed over the full surface and then becomes thin, simultaneously the molten metal will sink into the porous composition layer and lastly the molten metal will reach at the surface of cavity passing through the porous composition layer and results to solidify rapidly due to the rapid temperature down affected by the direct contact between the molten metal and the cavity surface, whereby a cast product has been obtained according to the present invention.

Referring now in detail to the pulverized thermal insulation agent, as the preferable material for coating the cavity surface, the following materials will be usable, that is, a non-reactive type pulverized body with a molten metal, more particularly these pulverized bodies having an electrification ability such as a boron or talc and the like, or a metallic oxide or metallic sulfide, or another pulverized bodies such as a metallic nitride and the like, or the other pulverized bodies mixed with a pulverized synthetic resin and the like.

In the above pulverized bodies, particularly it is further prefereable to use such a pulverized body having a lubrication ability as it is in state of the pulverized body in order to improve a die removal ability for removing a cast product from the cavity upon the completion of casting work. Referring to the lubrication type pulverized agent, it can give the examples from a stearate selected from the group consisting of a stearic acid and sodium, magnesium, zinc, calcium and the like; the examples from a pulverized synthetic resin selected from the group consisting of a stearate resin, fluorine resin, phthalocyanine resin, polyethylene resin, polypropylene resin and the like; the examples from a metallic oxide selected from the group consisting of indium, lead, black lead, molybdeum disulfide or $Na^2O$, BeO, MgO, $Al^2O^3$, $SiO^2$, CaO, $TiO^2$, $Cr^2O^3$, $MnO^2$, $Fe^2O^3$, FeO, MnO, PbO and the like; the examples from a mixtures with the above metallic oxides selected from the group consisting of talc, spinel, mullite and the like; and the examples from either single substance or the plurality of mixtures selected from the group consisting of WC, TiN, TiC, B4C, TiB, ZrC, SiC, Si3N4, BN and the like.

Referring to the particle size of pulverized insulation agent, a preferred diameter of the particle is to be less than or around at 0.2 mm per each particle in average, because the more the particle is larger, the more the coated layer tends to drop our easily from the cavity surfaces. In addition, it is also preferable to keep the composition density of pulverized insulation layer at less than 0.1 $g/cm^3$ in porous state.

It is referred to as to the method of coating the agent into the cavity. It can give several example methods such as an air gun method to spray the agent by compressed air jet, an electrostatic coating method to utilize a static electricity and a powder puff method to puff the agent powder pouched in a rosin bag for patting or rubbing the bag on the cavity surface by hand and the like.

In the above methods, however, substantially it can recommend to adopt the electrostatic coating method as the most advantageous method since this method can coat the agent easily with an uniformed thickness of layer regardless of the termperature fluctuation of the dies.

Conventionally, when such insulation agent is coated on a cavity, it is known that an wet type insulation agent is coated on the cavity by mixing the agent into a solvent such as a water, an alcohol, an oil and the like together with a dispersant.

When this dispersant is not used, the particle of the agent is further pulverized to microsituation preliminarilly in order to improve the dispersive ability wherein the processed agent and a binder are mixed together to make a solution for coating the agent to the cavity by the spray gun method. Upon the completion of spraying the solution agent on the cavity surface, the wet layer is forcedly dried to solidify the layer.

Figure 5:
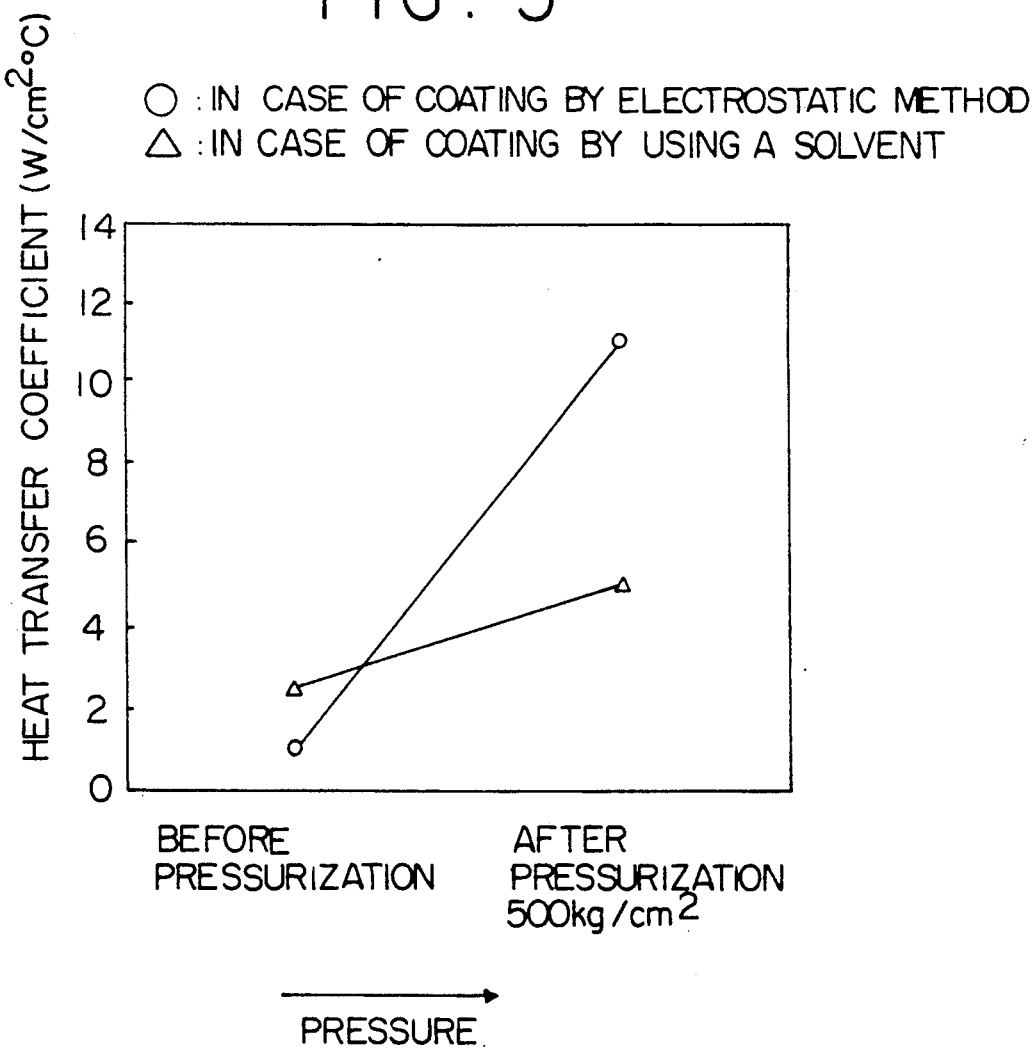
FIG. 5 is a graph for showing a relationship between a pressure and its heat transmission in two cases such as when a pulverized insulation agent is coated directly on a cavity surface as it is, and when an insulation agent is coated by dispersing the agent with a solvent. More particularly, according to these figures, it can estimate the solidifying speed of molten metal by the microscopic observation upon the microcomposition of products because it tends that the more the solidifying speed is increased, the more the crystal particle of microcomposition becames fine.

The above conventionaly methods, however, have disadvantages that the density of the insulation layer tends denser as shown in FIG. 5, therefore, the insulation ability displayed under the pressure from the weight gravity of molten metal is still maintained even when a more higher pressure is applied on the molten metal in the pressurization step of the present invention, consequently the solidifying time of molten metal is unnecessarily prolongod, that is, the total casting time is prolonged, because the molten metal can not sink into the insulation layer sufficiently so that the molten metal does not contact with the cavity surface directly, thus the insulation layer results to delay the cooling time of molten metal. This is one reason and as another reason, it is known that any insulation layer must be coated newly for each time of casting after the clean up of the earlier layer form the cavity. Notwithstanding, the earlier layer often remains partially on the cavity surface and causes a defect casting result, consequently the dimensional accuracy of cast products often spoiled due to the partial remainder of the earlier layer stuck on the cavity surface in which is caused by that the sinking of molten metal passing through the porous insulation layer at the cavity surface is not sufficient due to the luck of enough pressure according to the weight gravity of molten metal from the conventional filling method so that the more the casting time is elapsed, the more the partial remainder of earlier layer is stuck to the cavity surface. This is the second reason.

As a further disadvantage of such the wet type coating method utilizing the solution agent mixture with the pulverized agent in microsituation and binder, it is known that the casting time is compelled to be prolonged because of the necessity of some drying time for solidifying the wet type insulation layer after the coat of layer by the spray gun method. In addition to the delay of casting time, there in a fear to produce a defect products causing by catching some remainder such as the solvent contained within the undried layer into the molten metal.

In contrast for the above disadvantages involved with the conventional methods, according to the present invention, it provides to make the molten metal poured into the cavity to sink into the porous insulation layer under the high pressure applied upon the molten metal wherein the pressurized molten metal passes through the porous composition of the layer and reaches at the cavity surface to contact with there, consequently the molten metal is cooled down to solidify rapidly, whereby it is not only capable of saving the casting time but also can obtain a high quality final products.

In addition to the above, the used insulation layer can be easily peeled off from the cavity together with the cast product when the product is removed from the cavity upon the completion of one shot casting process without any remainder stuck on the cavity surface, consequently it results to produce a high quality product having an excellent accuracy in the dimension.

As to the thickness of the insulation layer, in other word which is a thickness formed by an air forms and the agent, it is allowed that the thickness is different case by case according to the particle size, because there is no limitation particularly as to the size and it is preferable to be made thin as much as possible in the manner of that the temperature of the molten metal filled in the cavities can be maintained until reaching at the pressurization step (within few seconds at latest).

FIG. 1 is a schematic illustration for showing a pulverized insulation agent coated over a cavity wall surface. In FIG. 1, the referential numbers (1) is the cavity wall, (2) is the pulverized insulation agent, (3) is an air, (4) is an insulation layer consisting of the pulverized insulation agent and the air.

As to the coating operation, the insulation layer (4) is formed on the cavity surface (1) by coating the agent on the cavity surface (1) for each casting cycle, wherein a molten metal is filled from an injection sleeve into the cavity (1). By coating the insulation agent within the interior of the injection sleeve preliminary before pouring the molten metal into the injection sleeve, it can maintain the temperature of the molten metal poured in the injection sleeve due to the insulation layer within the interior of the injection sleeve during the molten metal is deposited within the sleeve between the molten metal is poured in the sleeve and it is injected into the cavity (it is during only for few seconds), thus it can keep the molten metal in fresh state without any solidification due to a temperature drop, whereby it can produce a high quality cast products in stable state with a sufficient flow of molten metal throughout within the cavity if the pouring speed of molten metal is widely delayed more than a conventional speed (for example, 0.05 m/sec. to 1 m/sec.)

According to the present invention, this injection speed is mostly similar to the conventional speed at around 1 m/sec. in case of the conventional methods such as the gravity casting method or the low pressure casting method mentioned previously, because there is such fear that the injected molten metal tends to intermix with a generated gases from the molten metal into the molten metal itself and also the insulation layer formed on the cavity surface tends to be peeled off from the surface by the rush flow of molten metal if the injection speed would be sped up.

As to the pressurization step, it is operated that after filling the molten metal into the die cavity, the pouring gate is closed and a high pressure is applied upon the moten metal by an adequate way such as thrusting a pin and the like into the pouring gate, wherein the formed insulation layer having a porous composition is crushed thin by the high pressure applied to the molen metal, at the same time the molten metal sinks into and passes through the porous insulation layer, and finally it reaches at the cavity surface, consequently the molten metal is rapidly solidified wherein a cast product is completed. By providing a pressurizing device including the pin for adding the high pressure upon the molten metal, such the device can facilitate the gate cutting after the completion of casting work.

As explained in the above, this die casting method provided according to the present invention comprises that the pulverized insulation layer is coated on the cavity surface wherein the molten metal is filled with a slow pace and the high pressure is applied upon the molten metal filled in the cavity after the completion of filling the molten metal, whereby the following effects can be attained:

(1) When the molten metal is filled in the cavity, the molten metal is not directly contacted with the cavity surfaces, in addition the heat insulation effect possessed by the porous insulation layer acts multiply upon the molten metal so that it restricts the solidifying speed of molten metal filled in the cavity, whereby it can obtain a high grade cast product having a complex shape or a thin thickness due to a good flow of the molten metal into the cavity interiors without any scorched portion on the cavity surfaces, further it can obtain a defectless high quality product having a good casting skin even if the pouring speed of molten metal is delayed largely.

(2) Since it is possible to reduce a rapid thermal shock affecting to the cavity surface, it can prolong the life time of dies largely.

(3) According to the use of pulverized body possessing a lubricity itself, in other word, possessing a function of mold-releasing agent or a surface lubricant, whereby it is possible to save the additional work of coating the mold releasing agent as well as the additional process of the air blow process and so it can shorten the casting cycle, at the same time it is further advantageous that any conventional type mold-releasing agent which contains a liquid carrier is not required, consequently it can prevent the environmental pollution in the casting spot, the intermix of generated gases into the molten metal causing by the mold-releasing agent and a defect casting caused by a moisture remained in the cavity due to insufficient post drying treatment, whereby it can improve the quality of the final products in the casting process.

(4) Since this method of the present invention is operated so as to fill the molten metal with a slow pace, it can prevent the intermix of gases during the filling process, whereby it can obtain a good product having high quality and reliability without any blowhole or pin hole.

(5) Generally, in case of filling the molten metal with a slow pace, the conventional methods have a very narrow range of choice in the filling time and filling speed due to the fear of that it causes a failure of spreading the molten metal into every nook and corner of the die cavity. In contrast the present invention has a wide range of choice in the filling time and speed since it can restrict the rapid solidification of the molten metal poured in the cavity, whereby it can ease the casting conditions.

(6) Since the present invention is carried out so as to apply the high pressure onto the molten metal upon the completion of filling the molten metal into the cavity, the porous insulation layer formed by the pulverized insulation agent and air foam is crushed and then become thin according the presssurization, at the same time the molten metal sinks into and passes through the porous layer to contact with the cavity surface directly wherein the molten metal is rapidly cooled down and solidified, thereby it can operate the whole casting cycle to the same degree of the high pressure die casting method, and as shown in the photographs attached with this specification for substituting the drawings, it show that the present invention can produce a cast product which the microstructure is fine and with a dimentional accuracy as well as the high pressure die casting method.

(7) In summary, according to the present invention, this method colletively adopts such both advantages from the gravity casting method and the lower pressure casting method in which are capable of obtaining high quality cast products having fine and mechanically excellent properties with a good endurability, and also from the high pressure die casting method being capable of obtaining cast products having a complex shape with a good dimentional accuracy under a high productivity.

What is claimed is;

1. A method of casting a metallic product in a die cavity defined by walls, said method comprising the steps of:

(a) electrostatically coating the walls of said die cavity with a dried, pulverized insulating material so as to form a porous insulation layer on said walls, (b) slowly pouring molten metal in said die cavity so that the porous insulation layer is not damaged, said porous insulation layer preventing initial rapid cool down of the molten metal due to contact with said walls, and (c) applying mechanical pressure to the molten metal in the die cavity so that the molten metal will compress and crush the porous insulation layer with which said molten metal is in contact and so that said molten metal will pass through said porous insulation layer to contact the walls of the die cavity, thereby resulting in a rapid cooling of said molten metal and formation of said metallic product.

2. A method according to claim 1, wherein the porous insulation layer formed in step (a) has a density of less than 0.1 g/cm$^3$.

3. A method according to claim 1, including after step (c) the step of removing the metallic product with crushed insulation layer thereon from said mold cavity.

4. A method according to claim 1, wherein said insulating material is free of any mold-release agent.

* * * * *